US005205224A

United States Patent [19]

Durst

[11] Patent Number: 5,205,224

[45] Date of Patent: Apr. 27, 1993

[54] PROTECTABLE PASS-THROUGH DRAWER

[76] Inventor: Sharon A. Durst, 2304 Wallea Pl., Sacramento, Calif. 95833

[21] Appl. No.: 835,810

[22] Filed: Feb. 14, 1992

[51] Int. Cl.[5] ..... E06B 7/32

[52] U.S. Cl. ..... 109/19; 109/66; 232/43.1

[58] Field of Search ..... 109/15, 16, 19, 66; 232/43.1, 43.4

[56] References Cited

U.S. PATENT DOCUMENTS

| | | | |
|---|---|---|---|
| 1,256,360 | 2/1918 | Ohlson et al. | 109/19 |
| 2,562,632 | 7/1951 | Mosman | 109/66 |
| 2,730,053 | 1/1956 | Ellithorpe | 109/19 |
| 4,084,518 | 4/1978 | Carlson | 109/19 |
| 4,135,658 | 1/1979 | Hagberg | 232/43.1 |
| 4,190,004 | 2/1980 | Richardson | 109/19 |
| 4,351,247 | 9/1982 | Clark | 109/19 |
| 4,517,901 | 5/1985 | Clark | 109/19 |
| 4,596,358 | 6/1986 | Hagberg | 232/43.1 |
| 4,757,942 | 7/1988 | Young, Jr. | 232/43.4 X |

FOREIGN PATENT DOCUMENTS

| | | | |
|---|---|---|---|
| 0665001 | 4/1988 | Switzerland | 109/19 |

*Primary Examiner*—Lloyd A. Gall

*Attorney, Agent, or Firm*—Malin, Haley, DiMaggio & Crosby

[57] ABSTRACT

A security drawer allowing articles to pass through an otherwise impervious wall, said drawer having operative doors limiting access to the inside operator as controlled by movement of the drawer. When the drawer access door is opened, an exterior delivery door is tightly closed. When the access door is placed in an intermediate position, the access door and exterior door are closed. When the access door is placed in a service position, the access door is placed into support structure chamber forming an absolute barrier between the inside operator and the outside public while opening the exterior door so as to allow the public access to articles such as fast food on the shelf of the drawer. The primary object of the invention is to protect the operator from robbery by strategic door placement in conjunction with drawer placement. The preferred embodiment of the device is constructed of scratch resistant ballistic acrylic.

11 Claims, 3 Drawing Sheets

PROTECTABLE PASS-THROUGH DRAWER

FIELD OF INVENTION

This invention relates to a movable drawer for passing articles such as food stuffs through a fixed wall, and, in particular, to a horizontal shelf having operative doors isolating access to the shelf on either side of an otherwise impervious wall for transferring of large articles further providing the operator with complete isolation from the final delivery for security of the operator.

BACKGROUND OF INVENTION

The use of movable closures such as windows is well known in the art for transacting business through an otherwise impervious wall, typically in a drive up environment. In many instances the use of a pivoted window type opening is no longer a preferred manner in handling transactions due to security concerns especially dependent on the type of transaction taking place. For instance, drive up banking and automobile filling stations are two such locations wherein "drive-up" services pose a problem. Both business deal with large amounts of money potentially exposing the operators to robbery as well as the elements. To address this situation a number of devices have been devised to place a secure barrier between the operator and the public.

U.S. Pat. No. 4,640,200, issued to Richardson, and U.S. Pat. No. 3,994,243, issued to Anders, exemplifies the art regarding fixed barriers. Both patents address the problem described above by use of a robbery resistant transaction drawer. The disadvantage to the disclosed transaction drawers is their limitation in size and structural rigidity. The limitation in size makes the device suitable only for cash or small articles such as beverage cans. The structural rigidity defeats the robbery resistant qualities if the drawer is sized to allow large items to pass, accordingly a handgun may be extended through the oversize opening.

In this mobile age nearly every facet of society has discovered the benefit of dealing with public while in their automobile, most notably are the fast food restaurants. However, passage of food through an opening requires unique handling due to its variety of shape and size. For this reason most food transactions continue to occur through the use of an open window. The problem arises in that these operators must also deal with volumes of money making them potential targets for unsavory persons as described above.

U.S. Pat. No. 4,084,518 issued to Carlson discloses the use of a swivel drawer for passage of food. Carlson's device demonstrates the need for larger drawers due to the size of articles but fails to provide an absolute barrier between the operator and public during rotation, a failure due to its fixed structural rigidity.

What is needed in the art is an apparatus that allows for passing both small and large objects of dissimilar size through an otherwise impervious wall. In addition, the device needs to provide an absolute barrier between the operator and the receiver. For convenience the contents of the drawer should be visible. It is, therefore, to the effective resolution of the aforementioned problems and shortcomings that the present invention is directed.

SUMMARY OF INVENTION

Generally, the invention relates to a secure, movable drawer for transferring articles through an otherwise impervious wall, the drawer having operative doors limiting outside access to the inside operator at all times during the transfer of articles. The preferred embodiment employs transparent ballistic acrylic (bullet proof) for material of construction. The instant device allows articles, such as food or currency, to be transported through a wall by use of a drawer movable along a horizontal plane, while providing a vertical barrier at all times to protect the inside user. The drawer is coupled to an interior access door which permits the operator to access and control the location of the drawer. When the access door is open, the operator is free to access the contents while an exterior vertical delivery barrier remains tightly closed. When the access door is placed into an intermediate position, the access door and exterior door are both closed providing a double barrier. When the access door is placed in a service position, the access door is placed into the device's support structure interior chamber forming an absolute barrier between the operator and the outside while simultaneously opening the exterior door so as to allow the outside user access to the contents in the drawer.

Accordingly, the primary object of the invention is to provide a drawer to transfer articles such as fast food while protecting the inside operator of the pass-through drawer from an outside criminal element.

Another object of the instant invention is to provide a large working drawer for securely transferring articles through an otherwise impervious wall.

Still another object of the instant invention is to provide an apparatus or device that provides a dual environment barrier when the access door and exterior door are placed in an intermediate position.

Yet still another object of the instant invention is to provide a transparent pass through drawer and construction made of 1.25" UL rated Level I Medium Power Arms Scratch Resistant Ballistic Acrylic.

Other objects and advantages of this invention will become apparent from the following description taken in conjunction with the accompanying drawings wherein set forth, by way of illustration and example, certain embodiments of this invention. The drawings constitute a part of this specification and include exemplary embodiments of the present invention and illustrate various objects and features thereof.

BRIEF DESCRIPTION OF THE DRAWINGS

The invention may be better understood by reference to the drawings in which.

DETAILED DESCRIPTION OF THE INVENTION

As required, detailed embodiments of the present invention are disclosed herein, however, it is to be understood that the disclosed embodiments are merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Figure 1:
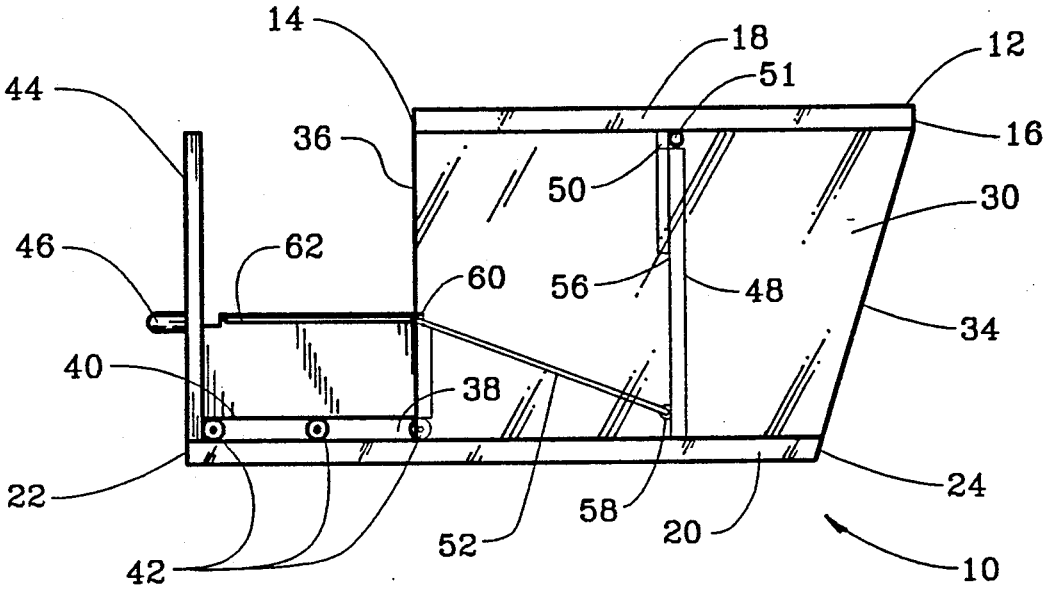
FIG. 1 is a side view of the instant invention in the open position.
Figure 2:
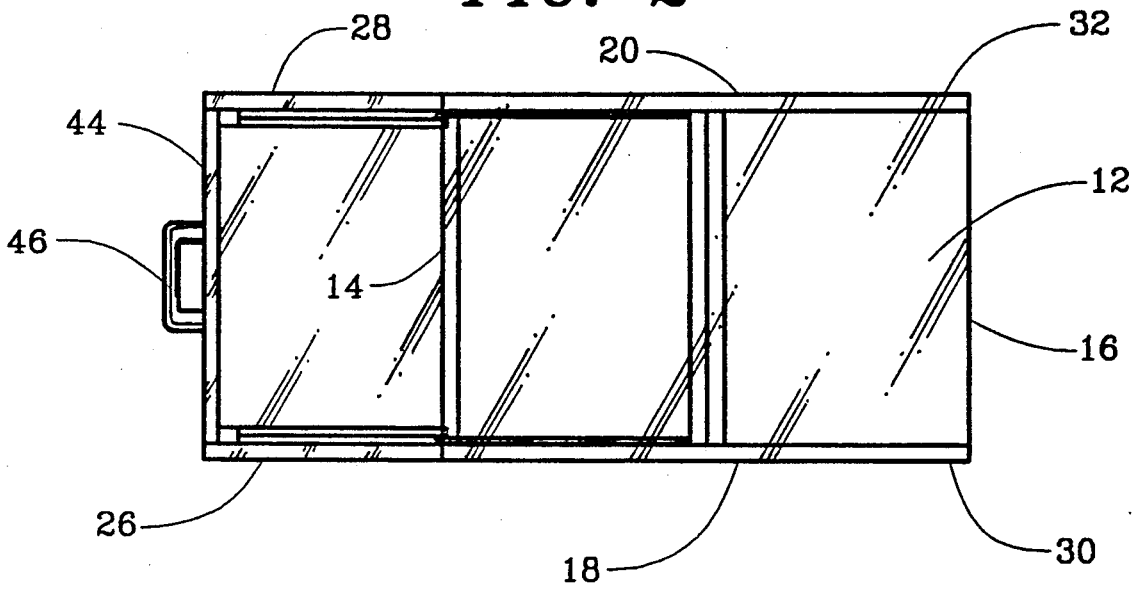
FIG. 2 is a top view of FIG. 1.

Now referring to FIGS. 1 and 2, numeral 10 designates the pass-through drawer of the instant invention comprising a support structure defined by a rectilinearly shaped, horizontally disposed upper wall 12 having a length between a top front edge 14 and a top rear edge 16, and a width between a first side edge 18 and second side edge 20. The upper wall 12 is positioned in a parallel plane above a rectilinearly shaped, horizontally disposed bottom wall 20, the lower wall having a length between a bottom front edge 22 and a bottom rear edge 24, and a width between a first bottom side edge 26 and second bottom side edge 28. The top wall 12 is positioned a fixed distance from the bottom wall 20 by a first side wall 30 and a second side wall 32. Actual distance is dependent upon the size of the articles to be carried, thus the drawer support structure can be proportionately sized. For instance, transfer of currency allows a miniturized device while transfer of food stuffs such as pizza requires a substantial structure. The rear upper portion of edge 34 of first side wall 30 is firmly joined to the rear edge of upper wall 12 at edge 16. The rear lower portion of edge 34 of first side wall 30 rigidly joins the rear edge of lower wall 20 at edge 24. Lower portion of edge 34 extends upwardly and outwardly from edge 24 to edge 16 for sheltering purposes. The front portion of upper edge 36 of first side wall 30 joins the front edge of upper wall 12 at edge 14, the front lower portion of edge 36 of first side wall 30 joins bottom wall 20 near the center of bottom wall as defined by front edge 22 and rear edge 24. The second side wall 32 forms a mirror image of first side wall 30. Walls 12, 20, 30 and 32 forms a structure adapted to be installed in an opening of an external wall of a building.

Within the drawer support structure is mounted a shelf 38 having a substantially flat rigid horizontal surface 40 for receipt of articles thereon. The shelf is movable along the length of lower wall 20 by means of a roller track 42 operatively associated with shelf 38. It should be noted that roller track 42 can be made integral with the shelf 38 or, alternatively, with the lower wall 20, operation of which is to allow slidable movement of the shelf 38 along the length of the lower wall 20. Various designs to accomplish roller track integration or employment of a plurality of rollers for said roller track is not deemed a limiting factor of the instant invention. Transparent access door 44 is rigidly secured to the shelf 38 at a right angle. Handle 46 is provided to manually control the position of the shelf 38 with respect to the access door 44.

A transparent delivery door 48 is disposed flush against stop bracket 50, the delivery door 48 hingedly attached to each side wall by hinge 51 operatively associated with the delivery door 48. The stop bracket 50 is narrowly disposed along the wall surface 12, 30 and 32 allowing door 48 to swing in a single direction without detracting from the interior chamber area. Each edge of the delivery door forms both a weather seal and finger barrier. A coupling for attaching the delivery door 48 to the drawer is provided by rods 52 and 54 constructed of a rigid material such as steel or the like. Rod 52 is rotatably attached to inner surface 56 of delivery door 48 a fixed distance above bottom wall 24 at coupling 58. The rod 52 is operatively associated with a slidable coupling mount 60 permanently fixed to shelf 38 having an elongated slot 62 disposed therein at a fixed distance above drawer surface 40. Rod 54 forms a mirror image of rod 52 on the opposite side of the shelf 38 attached to the delivery door 48 by a similar coupling, not shown, to coupling 58 and a slidably coupling, not shown, similar to mount 60 permanently fixed to shelf 38 at a fixed distance above the surface 40.

Figure 3:
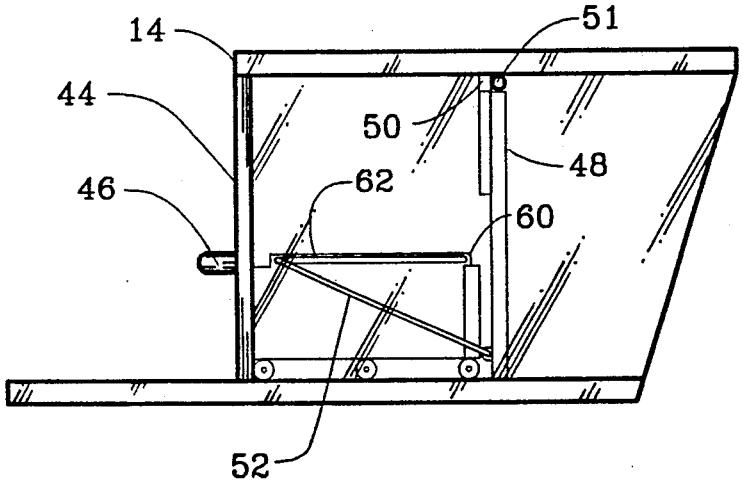
FIG. 3 is a side view of the instant invention in the intermediate closed position.

Referring to FIG. 3, the drawer is moved for placement of the access door 44 into an intermediate position as shown wherein rod 52 slides to the rear of slidable coupling mount 60 through elongated slot 62, access door 44 forming a seal around its perimeter by fitting within the interior chamber of the support structure beginning with front edge 14. Access door 44 and delivery door 48 form a dual barrier effectively shielding shelf 38 in the center of the wall.

Figure 4:
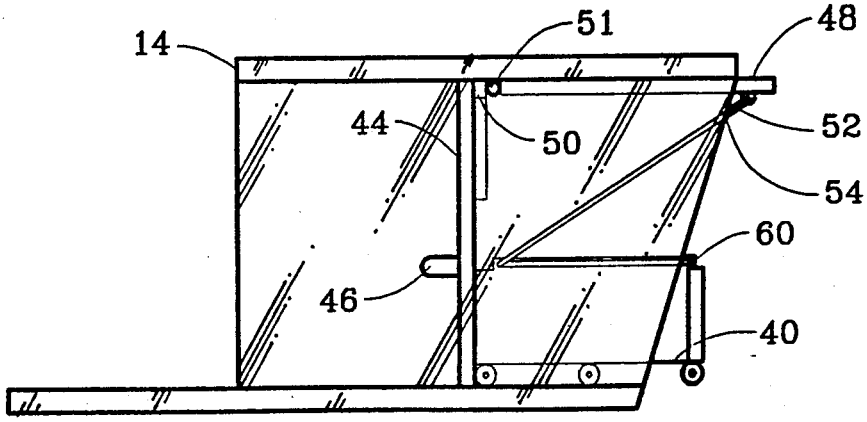
FIG. 4 is a side view of the instant invention in the delivery position.
Figure 5:
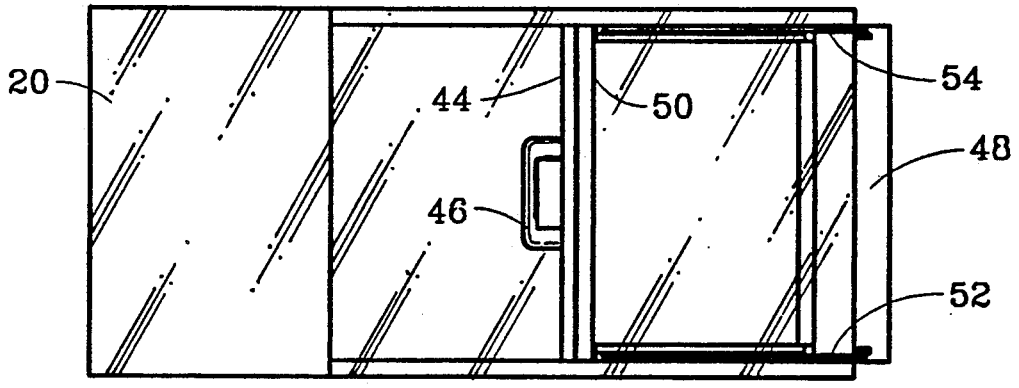
FIG. 5 is a top view of FIG. 4.

Now referring to FIGS. 4 and 5, delivery of articles such as fast food is accomplished by manually positioning the access door 44 against stop bracket 50 which simultaneously forces delivery door 48 into an upward open position by means of rods 52 and 54 operatively associated with slot 62 of drawer mount 60. The articles are readily retrievable from surface 40, the delivery door further providing coverage of the articles from overhead elements. After removal of articles from the shelf 38 gravity assists in closing the delivery door 48 forcing access wall 44 back to its intermediate position beneath forward edge 14 of upper wall 12 upon retraction of the drawer.

Figure 6:
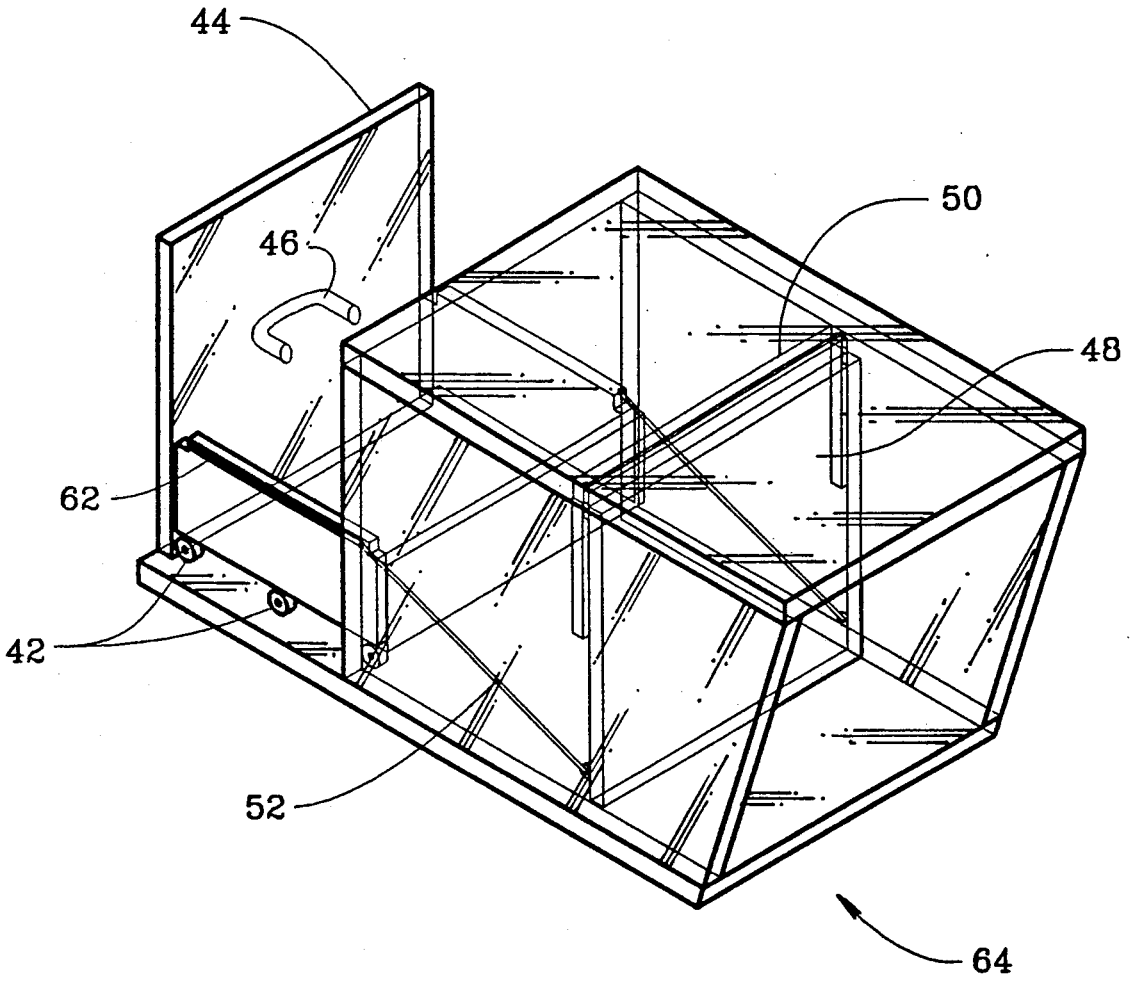
FIG. 6 is a pictorial perspective view of instant invention made from transparent materials.

FIG. 6 is a pictorial perspective view of instant invention. The device in the preferred embodiment is constructed of 1.25" UL rated Level I Medium Power Arms Scratch Resistant Ballistic Acrylic for the upper wall 12, lower wall 20, side walls 30, 32 and shelf 38 generally shown by support structure 64. Most beneficial to this device is the use of said ballistic acrylic for the access door 44 and delivery door 48 wherein the transparent material offers an unobstructed view into and through the instant device. The level of ballistic protection is not deemed limiting of this invention allowing Level II, III and so forth if additional ballistic protection is warranted.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What I claim as new and desire to secure by Letters Patent of the United States is:

1. A protectable pass-through drawer for securely transferring articles through a wall comprising: a support structure having a upper wall and a bottom wall, the upper wall and the bottom wall each having a first end and a second end, the upper wall positioned a fixed distance from the bottom wall by a first and second side wall; a drawer having a means for slidable movement of said drawer toward and away from the first and second ends and along the bottom wall of said support structure, said drawer having a substantially flat horizontal shelf surface for receipt of articles; a transparent access door rigidly secured to said drawer disposed at a right angle to the drawer surface; a transparent delivery door hingedly attached to the upper wall of said support structure intermediate the first end and the second end of the upper wall, said access door placing said delivery door in a closed vertical position and permitting placement of articles onto the drawer surface when said access door is opened, said access door causing said drawer to traverse said support structure while simultaneously opening said delivery door and allowing for external access to said drawer when said access door is closed; and a means for coupling said delivery door to said drawer.

2. The protectable pass-through drawer according to claim 1 wherein said means for slidable movement is further defined as a roller track.

3. The protectable pass-through drawer according to claim 2 wherein said bottom wall has said means for slidable movement attached thereto.

4. The protectable pass-through drawer according to claim 1 wherein said support structure is installed in an opening of an external wall of a building.

5. The protectable pass-through drawer according to claim 1, wherein said means for coupling is further defined as drawer mount permanently attached to said drawer having an elongated slot disposed therein for slidable positioning of a delivery door attachment.

6. The protectable pass-through drawer according to claim 5 wherein said delivery door attachment is further defined as at least one rod hingedly coupled to said delivery door and operatively associated with said elongated slot of said drawer mount.

7. The protectable pass-through drawer according to claim 1, wherein said access door has a height and width corresponding to an interior chamber of said support structure for slidable disposition therein effectively sealing said interior chamber.

8. The protectable pass-through drawer according to claim 1, wherein said access door includes a handle means to facilitate movement of said drawer along a horizontal plane.

9. The protectable pass-through drawer according to claim 1, wherein said transparent access door and said delivery door are constructed of 1.25" UL rated Level I Medium Power Arms Scratch Resistant Ballistic Acrylic.

10. A pass-through drawer comprising: a support structure defined by a rectilinear shaped horizontal disposed upper wall having a length and a width positioned in a parallel plane above a rectilinear shaped horizontal disposed bottom wall having a length and a width, the upper wall positioned a fixed distance from the bottom wall by a first and second side wall, the upper wall and the bottom wall each having a first end and a second end; a drawer having a roller track integral within said support structure to allow said drawer to be slidably moved toward and away from the first and second ends and along the bottom wall of said support structure, said drawer having a substantially flat horizontal shelf surface for receipt of articles; an access door rigidly secured to said drawer disposed at a right angle to the shelf surface; a delivery door hingedly attached to the upper wall of said support structure intermediate the first end and the second end of the upper wall; and a drawer mount permanently attached to said drawer having an elongated slot disposed therein for slidable positioning of at least one rod hingedly coupled to said delivery door; whereby said support structure is adapted to be installed in an opening of an external wall of a building wherein opening of said access door moves said rod to one end of the elongated slot placing said delivery door in a closed position and permitting placement of articles onto the shelf surface, closing of said access door causes said drawer to traverse said support structure simultaneously positioning said rod at the opposite end of said elongated slot opening said delivery door thereby allowing external access to said drawer.

11. The pass-through drawer according to claim 10, wherein said pass-through drawer is constructed of 1.25" UL rated Level I Medium Power Arms Scratch Resistant Ballistic Acrylic.

* * * * *